US006964512B2

(12) United States Patent
Brophy

(10) Patent No.: US 6,964,512 B2
(45) Date of Patent: Nov. 15, 2005

(54) PERSONAL ORGANIZATION TOOL

(76) Inventor: A. Daniel Brophy, 100 Harry Crescent, Sudbury, Ontario (CA) P3B 3E4

( * ) Notice: Subject to any disclaimer, the term of this patent is extended or adjusted under 35 U.S.C. 154(b) by 3 days.

(21) Appl. No.: 09/730,949

(22) Filed: Dec. 6, 2000

(65) Prior Publication Data

US 2002/0015360 A1 Feb. 7, 2002

(30) Foreign Application Priority Data

Jul. 28, 2000 (CA) ..... 2313427

(51) Int. Cl.[7] ..... G04F 1/00
(52) U.S. Cl. ..... 368/100; 368/28
(58) Field of Search ..... 368/28, 10, 37, 368/223, 76–77, 80; D10/3, 30; D19/21; 40/113, 115, 107, 111

(56) References Cited

U.S. PATENT DOCUMENTS

| | | | | |
|---|---|---|---|---|
| 1,819,063 A | * | 8/1931 | Barron | 116/316 |
| 2,411,185 A | * | 11/1946 | Bernstein | 40/115 |
| 2,741,082 A | * | 4/1956 | Elberg | 368/37 |
| 3,597,912 A | * | 8/1971 | Akahano | 368/37 |
| 4,208,870 A | * | 6/1980 | Cullom | 368/41 |
| 4,232,510 A | | 11/1980 | Tamaru et al. | 368/28 |
| 4,632,569 A | | 12/1986 | Gogniat | 368/35 |
| 4,674,889 A | | 6/1987 | Klaus | 368/28 |
| 4,740,932 A | | 4/1988 | Cephas et al. | 368/28 |
| 4,791,621 A | | 12/1988 | Wild et al. | 368/47 |
| 5,023,850 A | | 6/1991 | Metts et al. | 368/28 |
| 5,058,084 A | | 10/1991 | Riesen | 368/10 |
| 2,253,285 A | * | 9/1992 | Greenock | 368/28 |
| 5,177,712 A | | 1/1993 | Kakizawa | 368/28 |
| 5,235,562 A | | 8/1993 | Vaucher | 368/28 |
| 5,377,614 A | | 1/1995 | Glazer | 116/308 |
| 5,537,369 A | | 7/1996 | Wu | 368/10 |
| 5,855,006 A | | 12/1998 | Huemoeller et al. | 705/9 |
| 5,903,519 A | * | 5/1999 | Takahashi et al. | 368/35 |
| D433,348 S | * | 11/2000 | Kallestad et al. | D10/126 |
| D435,474 S | * | 12/2000 | Benson | D10/126 |
| 6,160,766 A | * | 12/2000 | Chiang | 368/37 |
| 6,169,707 B1 | * | 1/2001 | Newland | 368/10 |
| 6,278,662 B1 | * | 8/2001 | Gruber | 368/28 |
| 6,324,123 B1 | * | 11/2001 | Durso | 368/10 |
| 6,359,840 B1 | * | 3/2002 | Evans | 368/80 |

FOREIGN PATENT DOCUMENTS

| | | | |
|---|---|---|---|
| CA | 1277834 | 12/1990 | 40/7 |
| GB | 1471836 | 4/1977 | G09D 3/12 |

* cited by examiner

*Primary Examiner*—Kamand Cuneo
*Assistant Examiner*—Thanh S. Phan
(74) *Attorney, Agent, or Firm*—Gordon & Jacobson, P.C.

(57) ABSTRACT

Disclosed is a personal organization tool comprising an indicator and an analog display divided into areas representing days of the week to help people organize themselves and remind them of various events or activities. The tool may be used in co-operation with an apparatus for providing information. The tool is particularly useful for people with short-term memory loss who often experience difficulty in keeping track of when they are supposed to do something.

11 Claims, 5 Drawing Sheets

PERSONAL ORGANIZATION TOOL

FIELD OF THE INVENTION

The present invention relates to the field of personal organization tools, clocks and calendars.

BACKGROUND TO THE INVENTION

In today's fast-paced world, many people require increasing organization within their personal lives to ensure that tasks are done, appointments are kept and to generally remind them of the various things that are and will be occurring in their lives. To this end, devices such as calendars and clocks have been developed to help remind people of the time and the various events that occur in their lives.

Canadian patent 1,277,834 issued on Dec. 18, 1990 to Hoyeck discloses a multi-perpetual calendar. In one embodiment, a circular disc is divided into seven areas representing the days of the week and each of these is subdivided concentrically into areas representing days of the month. The circular disc is used in conjunction with another circular disc to give an indication of the day of the week that falls on a particular day in the month. The discs can be laminated to provide a surface on which to write notes.

U.S. Pat. No. 5,177,712 issued on Jan. 5, 1993 to Seiko Epson Corporation, the disclosure of which is hereby incorporated by reference, discloses a calendar display device for a timepiece (a watch) comprising an indicator and a display with each day of the week. While a user of the watch may be able to determine the day of the week, the patent does not disclose a tool for organizing a person's life. The timepiece described in this patent is too crowded with various other indicators and displays to be a simple and effective tool for personal organization. The day of the week display itself is a minor, ancillary portion of the overall watch and must be inspected closely to determine the day of the week. Such a device does not provide easy, at-a-glance day of the week information required by people, particularly elderly people. Furthermore, this device uses seven separate indicators to indicate each day of the week. The driving mechanism for the day of the week indicators is offset from the centre of the day of the week display, which results in some of the mechanism being outside the radius of the day of the week display. The day of the week display and mechanism are designed to be used solely within a device having other displays and indicators associated with it.

U.S. Pat. No. 5,058,084 issued on Oct. 15, 1991 to B-line AG discloses a clock for planning the sex of a child. The clock has differently marked display sections representing the days of fertility on which conception of a baby is most likely. This device is specifically adapted to an individual and does not have the flexibility to organize a wide variety of events. This device provides a display concerning the days of the month, not concerning the day of the week.

U.S. Pat. No. 5,377,614 issued on Jan. 3, 1995 to Glazer discloses a device to remind people to take pills. Rotatable dials are manually set to indicate the weekday, date and time for taking a medication. This device is inconvenient as the user must remember to set the date and time on the device and then must use a separate device for determining the actual present date in order to correlate the pill reminder device with the actual day of the week. The device described in this patent is specifically adapted for one purpose and does not provide flexibility for other events.

U.S. Pat. No. 5,235,562 issued on Aug. 10, 1993 to Compagnie des Montres Longines, Francillon S. A. discloses a timepiece with a second display to indicate the days of the month. An indicator in the second display moves through the days of the month describing an arc of 330 degrees at the end of which the indicator automatically moves back to the starting position. In this way, the indicator always moves back to the day 1 of the after it reaches the last day of the previous month.

U.S. Pat. No. 5,855,006 issued on Dec. 29, 1998 to Humware discloses a personal activity scheduling system based on software. A variety of activities can be programmed into the system. This patent does not disclose a simple indicator/display system that can be readily accessed at a glance and that requires no knowledge of computers. This system is particularly inconvenient for retired and/or elderly people who require a simple device that does not require specialized knowledge to operate.

U.S. Pat. No. 5,537,369 issued on Jul. 16, 1996 to Wu discloses a desk calendar-clock combination. The desk calendar can be weekly. This device does not have an indicator which automatically points to a day of the week to give a person an instant reminder. This device requires the user to manually flip the calendar pages. If the user forgets to flip the calendar page, the person may get confused as to the day of the week thus defeating the purpose of the device.

U.S. Pat. No. 5,023,850 issued on Jun. 11, 1991 to Metts et al., discloses a novelty clock for keeping animal time in relation to human time. The clock employs a frequency generator that produces pulses at a rate of sixty pulses per second multiplied by a factor particular for the animal in question to convert the time to the time for the animal.

U.S. Pat. No. 4,791,621 issued on Dec. 13, 1988 to Junghans Uhren Gmbh, the disclosure of which is hereby incorporated by reference, discloses a solar powered electric clock. The clockwork is driven by a motor mounted in the housing.

U.S. Pat. No. 4,740,932 issued on Apr. 26, 1988 to Cephas et al., discloses a desk top swing calendar in combination with a clock. The calendar is monthly and the individual pages of the calendar are manually flipped over a frame on which they rest.

U.S. Pat. No. 4,674,889 issued on Jun. 23, 1987 to IWC International Watch Co. AG discloses a watch with automatic display of the month and the day of the week. The watch includes complicated wheelworks that are adjustable only as a whole, thus, the association of individual displays with each other cannot be changed.

U.S. Pat. No. 4,632,569 issued on Dec. 30, 1986 to Montres Rado S. A. discloses a timepiece with a calendar. The days of the week may be indexed on a rotating disc such that the particular day of the week appears under a transparent zone and is thus visible to the user.

U.S. Pat. No. 4,232,510 issued on Nov. 11, 1980 to Citizen Watch Co., Ltd. discloses a timepiece with a means for indicating information other than the time, date and day. This timepiece employs a programmable circuit and an electronic memory for storing information about time and date that can be used in combination with a secondary function.

Despite the advances made in the art, there still remains a need for a simple and effective device for helping people organize their lives, especially on a weekly basis. This is particularly true for people who, due to advancing age, loss of visual acuity, loss of short term memory or routine use of prescription drugs, find themselves disoriented regarding time and position in the sequence of events that comprise the metronome of their lives. Clocks and wall calendars furnish some of the required orienting data but are insufficient. A missing essential piece of information is the name of the current day of the week. Importantly, a graphic representation of the progress of the current week is highly desirable to aid the intuition in the process of time location. Permitting access to such information quickly, conveniently and free of embarrassment is a desirable goal, which goal is obtainable by using a simple and highly visible or large device.

SUMMARY OF THE INVENTION

In one aspect, there is provided a personal organization tool comprising an indicator and an analog display divided into areas representing days of the week, wherein the indicator indicates the day of the week.

In another aspect, there is provided a personal organization tool comprising an indicator and an analog display divided into areas representing days of the week in cooperation with an apparatus for providing information, wherein the indicator indicates the day of the week.

There is further provided a use of a personal organization tool for organizing activities.

There is still further provided a method of organizing activities comprising providing a tool of this invention, defining activities to be done, and creating a correspondence between the activities and the areas on the display in the tool.

The personal organization tool can help people organize themselves and remind them of various events that take place in their lives. The tool is particularly, but not exclusively, useful for retired and/or elderly people who often experience difficulty in keeping track of when they are supposed to do something. Such difficulties may be due to short-term memory loss, to the monotone character of their daily routine or to other causes. The tool constitutes a substantial aid in tracking daily, weekly or sporadic events such as scheduled medications, visits by the doctor or nurse, garbage days, anticipated entertainment or any other regularly or irregularly occurring event. The tool advantageously combines some features of clocks and calendars but it is itself neither a clock nor a calendar, rather, it is a personal organization tool.

Elderly people in particular often require constant reassurance as to the day of the week. This tool provides an easy, at-a-glance reminder to such people without causing the embarrassment that they can experience if they have to closely inspect some device or ask someone in order to obtain the desired information. The social value of this feature cannot be underestimated. Such people need a quick and painless rescue from the disorientation that sometimes besets them due to the sameness of each day, often compounded by short-term memory loss. The rescue is ideally furnished at the moment they feel the need, and, if the rescue is self-administered, the sense of inadequacy or embarrassment that may accompany the indication of diminished capacity can be reduced. Serious discomfiture does, in some cases, even lead to panic and, consequently, to increased disorientation. While prior art clocks and calendars may be used to lessen such feelings, they are insufficient. The personal organization tool with its day of the week information fills the gap between clocks and calendars. The tool provides necessary reassurance in a simple and effective manner so that the user feels more comfortable and less embarrassed. Such considerations have been largely overlooked in the prior art. Most prior art devices require overt close inspection to elicit the required information. In the tool of the present invention, the day of the week display is generally larger than any other display in the tool so the display does not require overt close inspection to elicit the necessary information. The day of the week display in the tool is generally dedicated, central and dominant.

The tool comprises an indicator and an analog display divided into areas representing days of the week. The days of the week may be arranged in any manner on the display. However, the days of the week are preferably arranged from Sunday to Saturday or from Monday to Sunday. More preferably, the days of the week are arranged in an essentially or substantially left-to-right manner from Sunday to Saturday or from Monday to Sunday. Such an arrangement is ergonomically more efficient as many cultures naturally read from left to right and the days of the week are normally presented from Sunday to Saturday or from Monday to Sunday. Even more preferably, the days of the week are arranged in an essentially left-to-right manner from Sunday to Saturday on the display.

The areas representing days of the week may be further subdivided into regions representing parts of a day, preferably into four regions representing quarter day periods. Thus, early morning, morning, afternoon and evening may be represented following a natural division of activities that many people follow. Such an arrangement is especially useful for people taking medication several times a day.

The indicator can be anything that can be perceived in relation to the display and that will indicate the area or region of the display that corresponds to the current day of the week and/or quarter day. For example, a large pointer, such as in a dial type thermometer or an analog clock, or a light in each of the areas or regions are useful indicators. A pointer is preferred. Pointers and lights may also be used in concert.

The indicator and the display co-operate to give an indication of the day of the week. This can be accomplished by either moving the indicator in relation to a static display or by moving the display in relation to a static indicator. It is preferred to move the indicator in relation to a static display as this maintains the most ergonomically favourable arrangement of the days of the week.

The indicator (or display) can be moved either manually or automatically to change the indication of the indicator. It is preferred that the indication changes automatically since the user will not be required to remember to change it.

When the indicator is a light, such automatic change in indication can be accomplished through a timer linked to the lights via an electric circuit. When the time for changing the indication occurs, the timer will send a signal to the lit light to turn it off and a second signal to the next light to turn it on. Electrical power to operate the circuit can be obtained, for example, from a battery, a solar cell or a combination of a battery and a solar cell. A solar cell may operate the circuit directly or may be used to recharge a battery or to charge a capacitor, which battery or capacitor operates the circuit. A battery-operated device is preferred.

When the indicator is an element such as a pointer, automatic movement can be accomplished by linking any constant speed motor (such as a motor in an analog clock mechanism) to the indicator spindle in such a way as to provide exactly one revolution per week. The rotation may be smooth, intermittent or semi-intermittent. Such a device can be powered mechanically or electrically. Electrical power can be obtained, for example, from a battery, a solar cell or from a combination of a battery and a solar cell. A solar cell may power the device directly or may be used to recharge a battery or to charge a capacitor, which battery or capacitor powers the device. Mechanical power can be obtained, for example, from a spring motor or a pendulum. A battery-operated device is preferred.

During the operation of the tool, the indicator can move either in a continuous manner, such as in most clocks, or in an essentially or substantially stepwise manner. A stepwise movement is preferred. In moving stepwise, the indicator can be made to dwell substantially in the middle of an area or a region; thus, spending less time in motion from one region to the next. There will be little doubt in the mind of the user as to the area or region in which the indicator is pointing. It is apparent to one skilled in the art that when a pointer is used as an indicator, some minimal amount of time will be required for the pointer to move from one region or area to the next but that the pointer will usually be essentially stationary. Thus, over the time scale of such a tool, the movement of the pointer is considered to be stepwise. The stepwise movement eliminates the need to reset the tool at the semi-yearly changes between Standard Time and Daylight Savings Time.

While more than one indicator can be used in the tool, it is preferred to use just one indicator in order to reduce the possibility of confusing the user. More preferably, the one indicator is dedicated to the one task of indicating the day of the week. In this manner, the tool is simpler and easier to use.

The indicator can move in either a clockwise or counter-clockwise direction in relation to the display depending on the way the display is set up. In a preferred embodiment, the essentially left-to-right arrangement of the days of the week on the display is maintained whether the indicator moves clockwise or counter-clockwise.

The display is designed to be simple and effective for use in organizing a person's activities, particularly weekly activities. The display can be any convenient shape. Polygonal, substantially circular or substantially semi-circular shapes are typical. A circular shape takes advantage of people's familiarity with clocks making it less likely that a person will become confused when using the tool. The tool is generally a large size and the simple, effective display greatly assists viewing the tool from a wide angle.

While the display can be any size, it is preferably large and easy to read. A large size is particularly advantageous since the tool can be then be mounted on a wall or set as a free-standing item in a conspicuous area such as on a desk or counter top thereby being easily referred to by a person. Thus, a large sized tool is more effective at providing information in an easily accessible and embarrassment-free manner. When the tool is free-standing, it is conveniently set in a stand or has a stand integrated into it. Typically, the tool's circular dial is about 2.5 inches in diameter for a desk-top model and much larger for other locations such as walls. Tools that are about six inches in diameter or larger or even about twelve inches in diameter or larger can be constructed.

When used in co-operation with an apparatus that provides information, the tool is a particularly effective organizational tool. Each area and/or region on the display may be made to correspond to specific information. The user can then determine at a glance the nature of the activity required on any given day or in any given quarter day and determine whether it is time to conduct that activity. The apparatus is especially useful for providing scheduling information. For example, an apparatus such as a pill container or a set of pill containers can be placed to correspond to specific days of the week or quarter days in order to provide a person with an accessible way of determining when to take the pills.

In another embodiment, an apparatus such as a surface for posting notes can be arranged in relation to the areas and regions of the display to provide information on the various activities that have been planned for that time period. Such a surface can take the form of a rim around the outside of the display or the surface may be integrated as part of the display. The surface can be made of a smooth material such as plastic or metal for posting releasable sticky notes or for taping notes on to the apparatus. The surface can also be made of wood or cork for pinning notes. The surface can also be a writable surface such as a chalkboard or paper mounted on a support.

The areas and/or regions on the display can be further coded, for example by using colouring or lettering, to facilitate the correspondence between the area and/or region and the information in the apparatus. Thus, for example, colour coding on pill containers may be coordinated with colour coding in the areas and/or regions for ease of determining when to take a medication.

The apparatus is preferably attached to the display of the tool. More preferably, the apparatus is an integral part of the display.

The tool can also be adapted for use by a person with visual impairment. Large markings on the display and/or apparatus can be used to aid people with some visual impairment. For people with greater visual impairment, the areas and regions can be separated from each other by a raised boundary and the markings on the display and/or apparatus can be made readable by touch. Having the area and region boundaries so raised will help people with visual impairment determine where the indicator is pointing, especially if the days of the week are arranged in their natural order from left-to-right. Markings on the display and on the apparatus can be made in Braille or another manner familiar to the visually impaired. Sounds that are pressure activated can also be employed in this capacity.

DESCRIPTION OF PREFERRED EMBODIMENTS

By way of example only, preferred embodiments are described in relation to the accompanying drawings in which.

Figure 1:
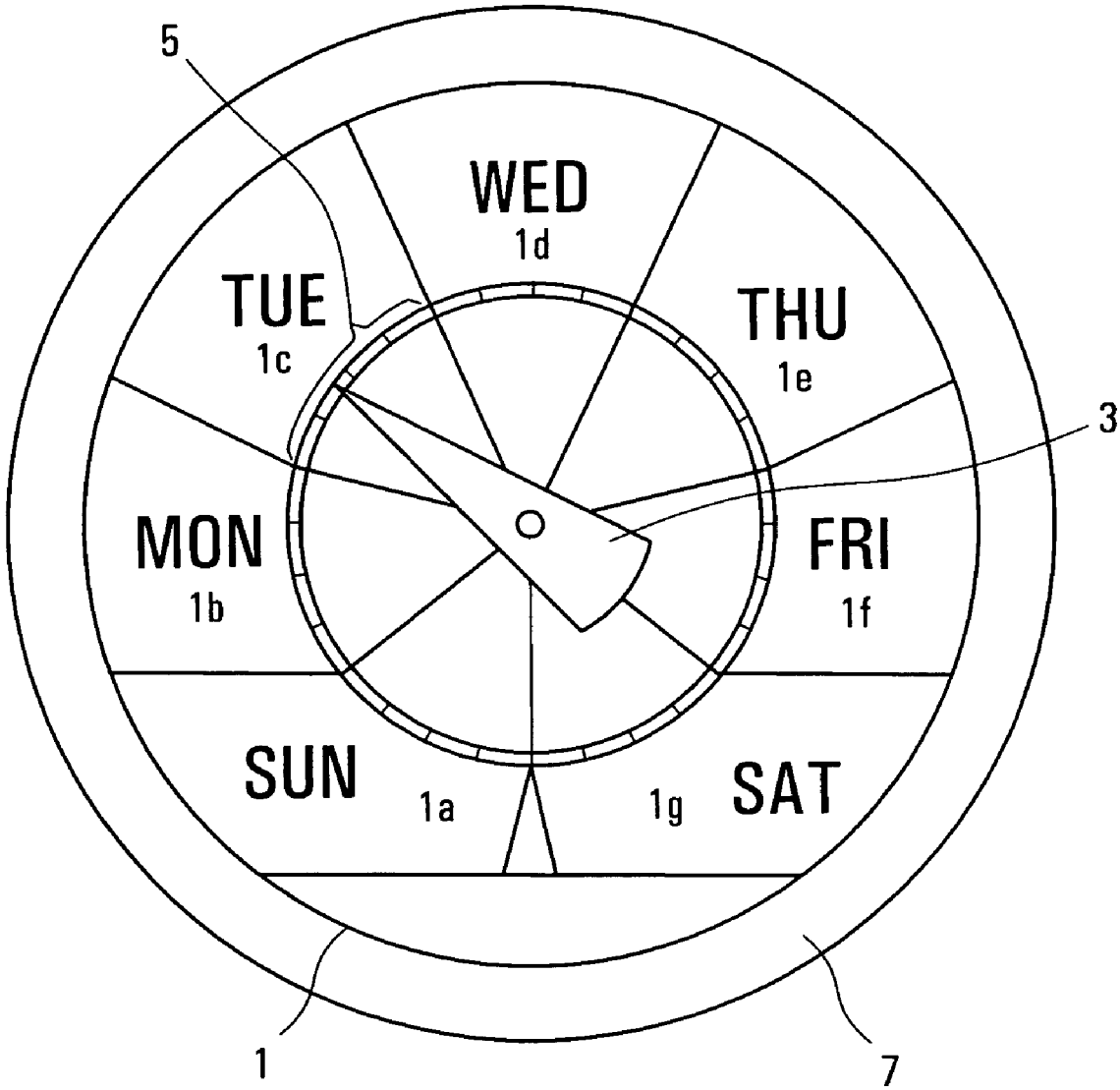
FIG. 1 is a schematic drawing of a front view of an embodiment of the invention having a triangular indicator and a circular display.

In FIG. 1 there is a wedge-shaped indicator (3) in the form of a pointer and a substantially circular display (1) divided into seven essentially equally spaced areas **(1*a* to 1*g*) representing the days of the week. Each area has an abbreviation of the day of the week printed therein. The areas are arranged such that the days of the week read essentially from left-to-right (clockwise) from Sunday (1*a*) to Saturday (1*g*). Wednesday (1*d*) is located at the top of the display (1). This is considered to be the most ergonomic arrangement since most people in the North American culture consider Sunday to be the first day of the week and read from left to right. Each area is further subdivided into four regions (5)** of substantially equal size representing quarter days in order to provide a more particular indication of the part of the day so that more precise information can be had concerning activities in a specific quarter of the day. These regions are marked as segments on a ring that is concentric with the outer edge of the display.

An annular surface (7) disposed around the display forms a rim on which notes may be posted. The indicator (3) moves in a clockwise direction driven by a device comprising an analog clock mechanism (see FIGS. 2A and 2B).

Figure 2A:
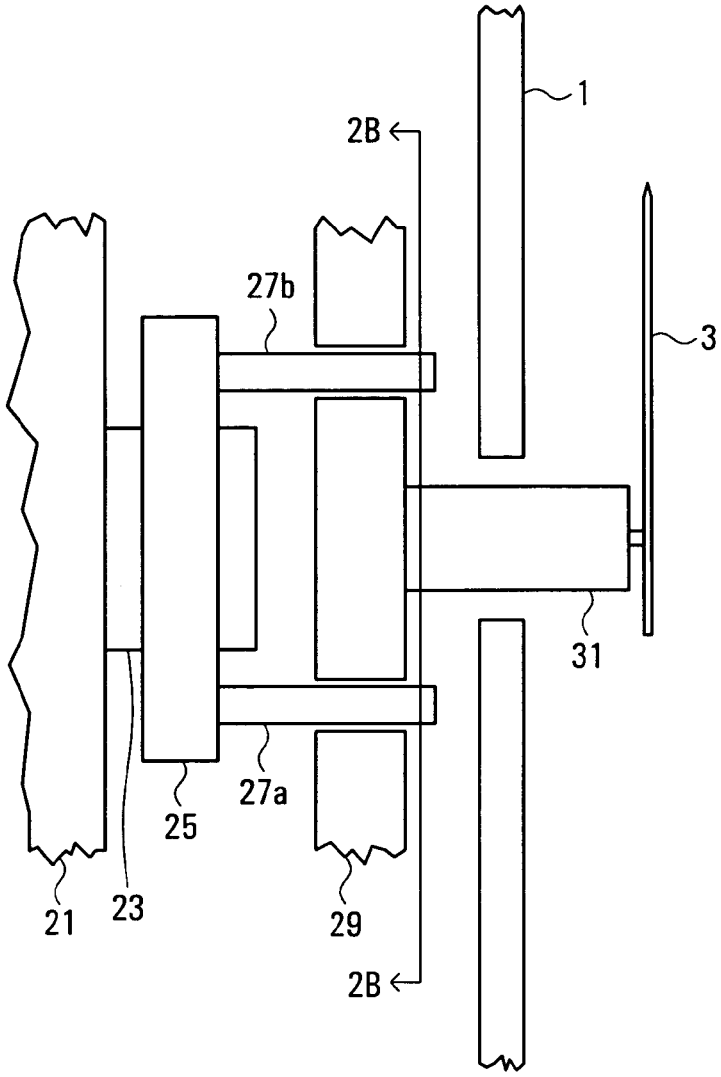
FIG. 2A is a schematic drawing of a side view of one embodiment of a device that controls the movement of an indicator.

FIG. 2A is a schematic side view of a device that controls the movement of the indicator. An analog clock mechanism (21) from a standard twelve-hour clock turns an hour spindle (23) that is mounted on the clock mechanism. The hour spindle turns a crank body (25) that is mounted on the hour spindle. Two crank pins (27*a* and 27*b*) are mounted on the crank body and turn with the crank body. The crank pins are engaged by a slotted wheel (29) that is forced to turn by the crank pins when the crank body turns. An indicator spindle (31) is mounted on the slotted wheel and turns with the slotted wheel. An indicator (3) mounted on the indicator spindle turns with the indicator spindle to give an indication of the day of the week that is displayed on the display (1). Depending on whether it is desired to move the indicator in a clockwise or counter-clockwise direction, the clock mechanism can be rigged to turn the hour spindle in a counter-clockwise or clockwise direction.

Figure 2B:
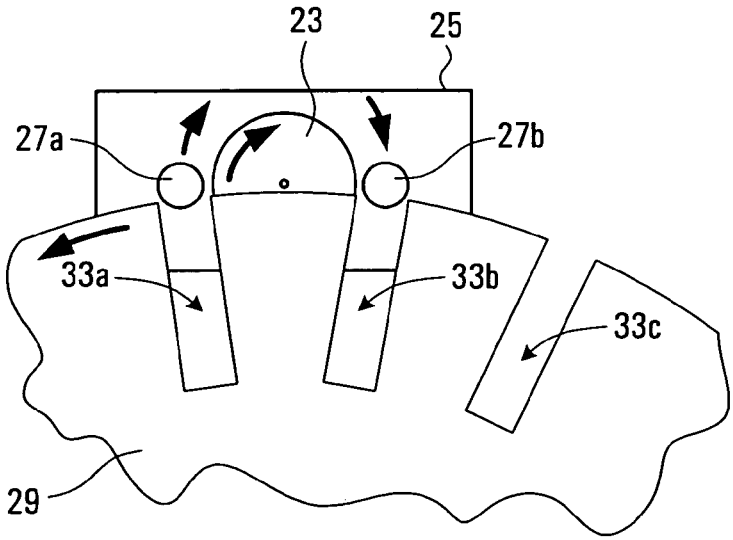
FIG. 2B is a schematic drawing of a partial transverse section through the slotted wheel of the device depicted in FIG. 2A.

In FIG. 2A and FIG. 2B, the hour spindle turns at a rate of 14:1 when compared to the indicator spindle. Thus, there are twenty-eight slots in the slotted wheel to accommodate the two crank pins. This arrangement permits the indicator to pass a full 360 degrees around the circle in a one week. Since the standard clock mechanism is on a half day cycle, the 14:1 ratio requires the clock mechanism to turn the hour spindle fourteen times in order to permit the two crank pins to turn the indicator spindle one full revolution.

Two crank pins are not necessary. If one crank pin is used, then there must be fourteen slots in the slotted wheel to turn the indicator spindle once for every fourteen revolutions of the hour spindle. Any convenient combination can be used. Two crank pins are preferred over one crank pin since two crank pins inhibit the slotted wheel from wandering which may be caused, for example, by vibrations in the tool, especially vibrations that are external to the tool.

The crank pins can be replaced by an appropriately sized gear or gear system to maintain the 14:1 ratio when a standard twelve hour clock mechanism is used. The slotted wheel can be replaced by a gear or gear system, again provided the correct ratio of 14:1 is maintained between the hour spindle and the indicator spindle. The use of such a gear would make the indicator movement control device larger in the present tool and may interfere with the design of the tool. Using a crank pin system offers the advantage of requiring a smaller slotted wheel than if gears are used. Therefore, a crank pin system, especially one with two crank pins, is preferred.

FIG. 2B is a schematic of a partial transverse section of the device depicted in FIG. 2A to further clarify how the parts of the device co-operate to move the indicator. As the hour spindle (23) turns, the crank body (25) also turns and the crank pins turn with the crank body. A crank pin (27*b*) is engaged by a slot (33*b*) of the slotted wheel (29) in such a manner that as the crank body turns, the crank pin (27*b*) enters slot (33*b*) forcing the slotted wheel to turn. At the same time, the crank pin (27*a*) exits from slot (33*a*). As the crank body turns one half revolution, the crank pin (27*b*) exits the slot (33*b*) and crank pin (27*a*) enters the slot (33*c*) just behind slot (33*b*) and the pattern is repeated.

Figure 3:
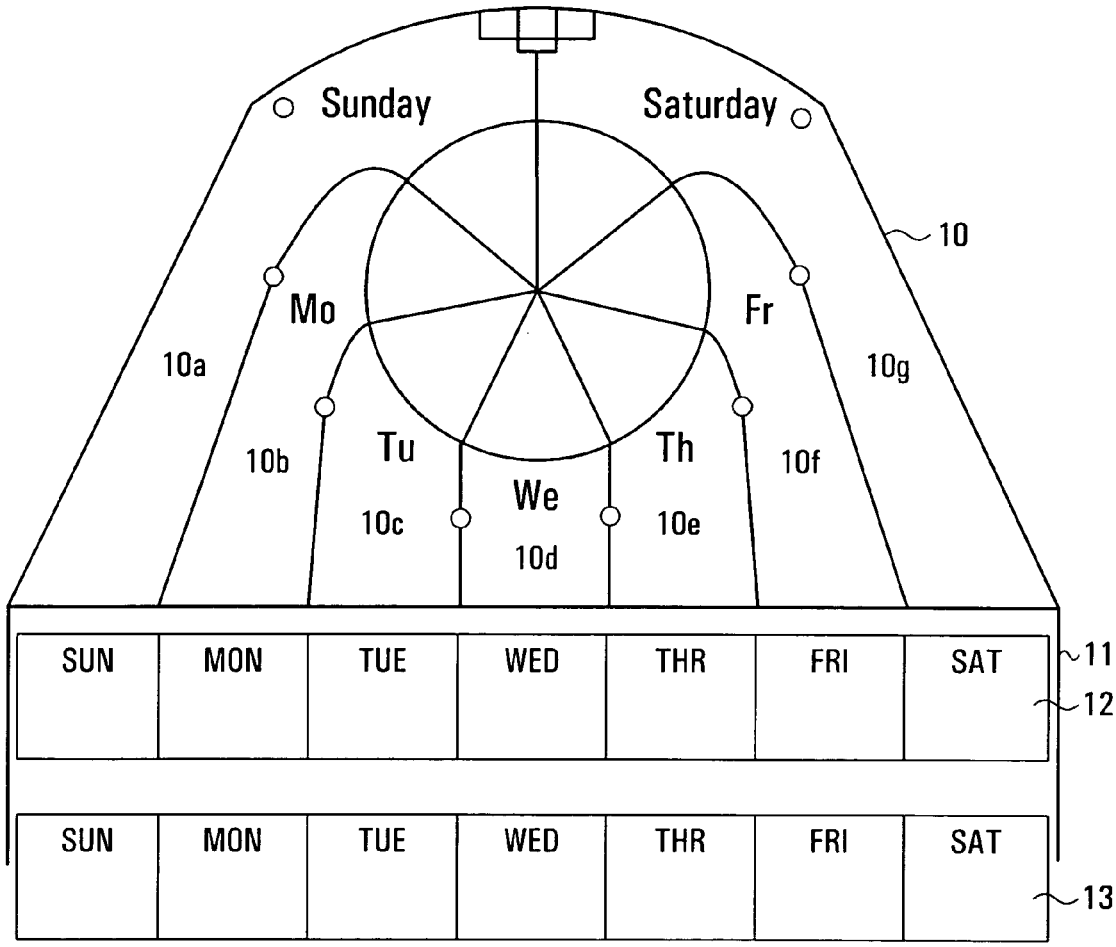
FIG. 3 is a schematic drawing of an alternate embodiment of the invention having a semi-circular display.

The display (10) of FIG. 3 is substantially semi-circular in shape and is divided into seven areas (10*a* to 10*g*) representing the days of the week arranged in an essentially left-to-right manner from Sunday (10*a*) to Saturday (10*g*). The indicator (not shown) is a wedge-shaped pointer similar to that in FIG. 1 and moves in a counter-clockwise direction. An apparatus comprising a set of pill containers (12) and a frame (11) for holding the pill containers is arranged along the bottom edge of the display such that the pill containers sit in front of the display. A second set of pill containers (13) sits in front of the first set of pill containers (12). Both the areas in the display and the pill containers are labelled with abbreviations of the days of the week to facilitate matching the day to the correct pill container.

Figure 4:
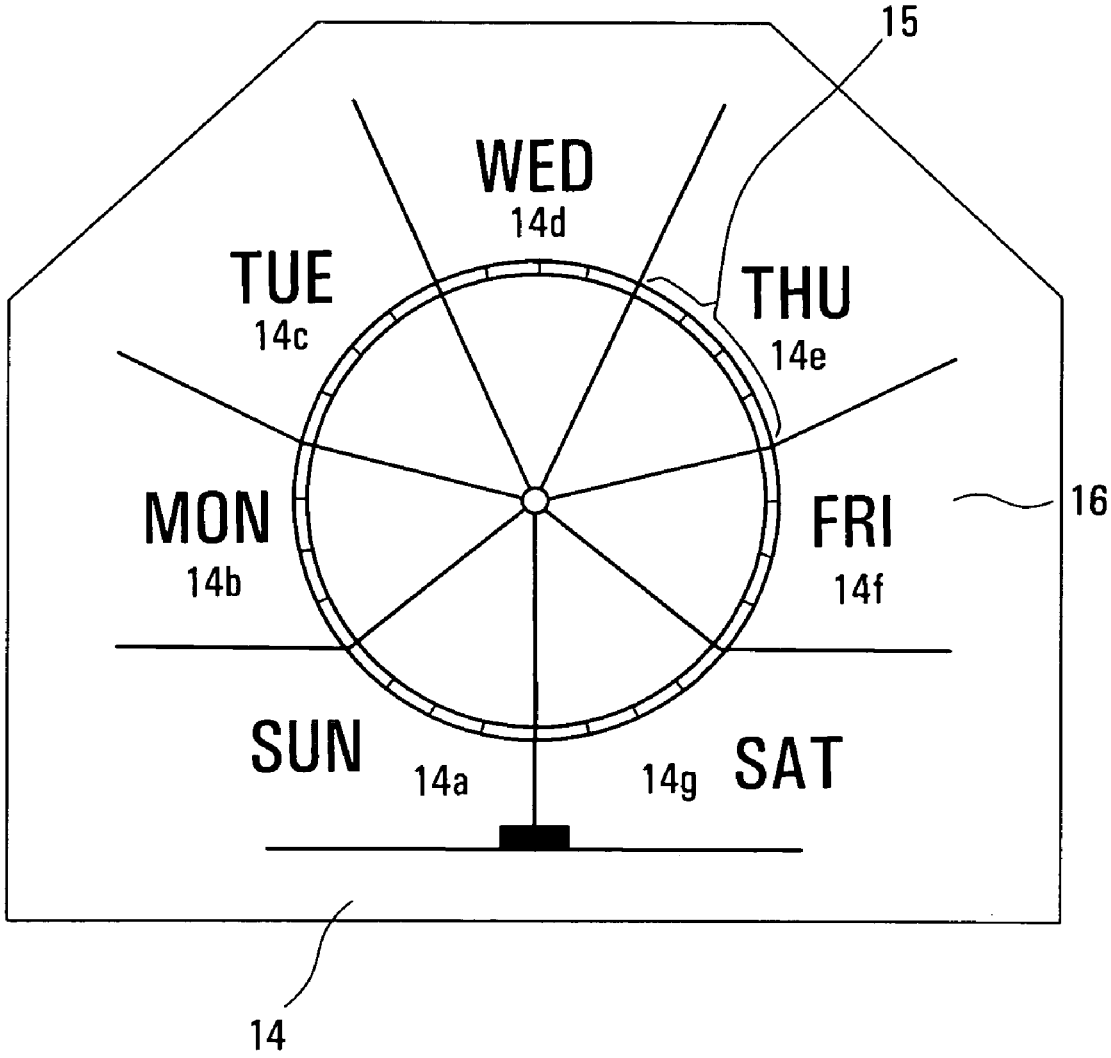
FIG. 4 is a schematic drawing of an alternate embodiment of the invention having a polygonal display.

The polygonal display (14) of FIG. 4 is divided into seven areas (14*a* to 14*g*) representing the days of the week arranged in an essentially left-to-right manner (clockwise) from Sunday (14*a*) to Saturday (14*g*). Each day of the week is further subdivided into four regions (15) representing quarter days in order to provide a more particular indication of the part of the day so that more precise information can be had concerning activities in a specific quarter of the day. The indicator (not shown) is a wedge-shaped pointer similar to that of FIG. 1 and moves in a clockwise direction. An apparatus (16) comprising a surface for posting information is integrated as part of the display (14).

Figure 5:
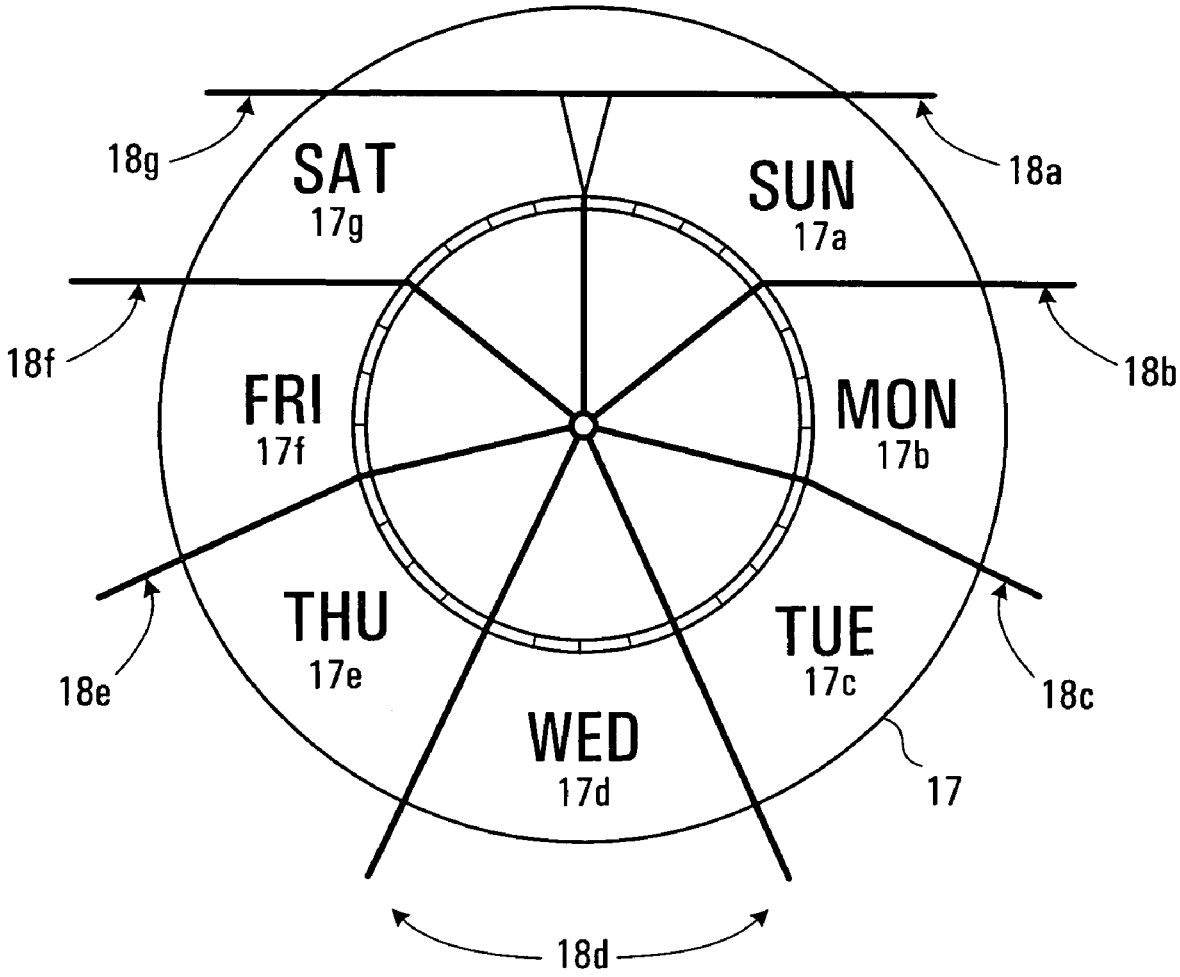
FIG. 5 is a schematic drawing of an alternate embodiment of the invention having a circular display.

The display (17) of FIG. 5 is circular in shape and is divided into seven areas (17*a* to 17*g*) representing the days of the week arranged in an essentially right-to-left (clockwise) manner from Sunday (17*a*) to Saturday (17*g*). The indicator (not shown) is a wedge-shaped pointer similar to that of FIG. 1 and moves in a clockwise direction. An apparatus comprising a set of ridges (18*a* to 18*g*) extending beyond the display can be used to display information. For example, notes or pill bottles or other informative elements can be attached to the ridges and will hang into the appropriate area to provide information concerning a given day of the week. The ridges may form an extension of the boundaries between the areas and/or regions of the display. In FIG. 5, the ridges form an extension of the boundaries between the areas of the display.

What is claimed is:

1. A personal organization tool comprising (a) a substantially circular, substantially semi-circular or polygonal analog display divided into seven areas representing the seven days of a single week arranged in a counter-clockwise manner with Sunday occupying an area to the left of the twelve o'clock position and Saturday occupying an area to the right of the twelve o'clock position or with Monday occupying an area to the left of the twelve o'clock position and Sunday occupying an area to the right of the twelve o'clock position, when viewed by a user of the tool;

(b) a movable indicator for indicating one of the seven days, the movable indicator movable in a counter-clockwise direction; and (c) means for providing the user with user-defined scheduling information corresponding to each area of the display.

2. The tool of claim 1, wherein the display is substantially semi-circular and Sunday occupies an area to the left of the twelve o'clock position and Saturday occupies an area to the right of the twelve o'clock position.

3. The tool of claim 1, wherein the areas representing the days of the week are each further subdivided into four regions representing quarter days and the indicator indicates the quarter day.

4. The tool of claim 3, wherein the scheduling information means provides user-defined scheduling information corresponding to each region.

5. The tool of claim 1, wherein the scheduling information means is a pill container, a set of pills or a surface for posting notes.

6. The tool of claim 1, wherein the tool is adapted for mounting on a wall, a desktop or a countertop.

7. The tool of claim 1, wherein the indicator is a pointer which automatically changes its indication in an essentially stepwise manner.

8. The tool of claim 1, wherein the indicator is moved by an analog clock mechanism.

9. The tool of claim 8, wherein:

(a) an hour spindle is mounted on the clock mechanism which turns the hour spindle;

(b) a crank body having a crank pin is mounted on the hour spindle which turns the crank body;

(c) a slotted wheel is engaged by the crank pin such that when the crank body turns, the crank pin turns the slotted wheel;

(d) an indicator spindle is mounted on the slotted wheel which turns the indicator spindle; and (e) the indicator is mounted on the indicator spindle which turns the indicator to give an indication of the day of the week.

10. The tool of claim 9, wherein the hour spindle turns at a rate of 14:1 compared to the indicator spindle and wherein the crank body has two crank pins.

11. A personal organization tool comprising:

(a) a substantially circular or semi-circular analog display divided into seven areas representing the seven days of a week arranged in a counter-clockwise manner with Sunday occupying an area to the left of the twelve o'clock position and Saturday occupying an area to the right of the twelve o'clock position, and (b) a movable indicator for indicating one of said seven days, said movable indicator being movable in a counter-clockwise direction.

* * * * *